US011178490B2

(12) United States Patent
Heinz

(10) Patent No.: US 11,178,490 B2
(45) Date of Patent: Nov. 16, 2021

(54) DIAPHRAGM FOR ACOUSTIC TRANSDUCER

(71) Applicant: HEDD Audio GmbH, Berlin (DE)

(72) Inventor: Klaus Heinz, Berlin (DE)

(73) Assignee: HEDD Audio GmbH, Berlin (DE)

( * ) Notice: Subject to any disclaimer, the term of this patent is extended or adjusted under 35 U.S.C. 154(b) by 0 days.

(21) Appl. No.: 16/864,189

(22) Filed: May 1, 2020

(65) Prior Publication Data

US 2020/0351591 A1 Nov. 5, 2020

(30) Foreign Application Priority Data

May 3, 2019 (DE) ..... 10 2019 111 578.7

(51) Int. Cl.
*H04R 7/14* (2006.01)

(52) U.S. Cl.
CPC ..... *H04R 7/14* (2013.01)

(58) Field of Classification Search
CPC ..... H04R 7/14; H04R 1/22; H04R 9/046
See application file for complete search history.

(56) References Cited

U.S. PATENT DOCUMENTS

| | | | | |
|---|---|---|---|---|
| 1,566,337 A | 12/1925 | Martin | | |
| 4,473,723 A | 9/1984 | Hobrough | | |
| 6,201,874 B1 * | 3/2001 | Croft, III | ..... | H04R 7/14 367/170 |

FOREIGN PATENT DOCUMENTS

| | | | | |
|---|---|---|---|---|
| DE | 102004059067 A1 | 7/2006 | | |
| WO | 9907183 A1 | 2/1999 | | |
| WO | WO-9907183 A1 * | 2/1999 | ..... | H04R 7/14 |

OTHER PUBLICATIONS

European Action dated Sep. 20, 2020.

* cited by examiner

*Primary Examiner* — Brian Ensey
(74) *Attorney, Agent, or Firm* — Bond Schoeneck and King PLLC; David Nocilly

(57) ABSTRACT

What is disclosed is a diaphragm for an acoustic AMT transducer. The diaphragm is folded such that the folds form pockets (11 . . . 15), and the pockets next to each other are alternatingly open on one and the other face of the diaphragm. The pockets (11 . . . 15) are dimensioned so that the transformation ratio of the diaphragm velocity to the velocity of the air driven by the pockets in use of the transducer varies steadily from pocket to pocket across the diaphragm. For example, the respective width, depth and/or length of the pockets increases or decreases steadily from pocket to pocket across a plurality of said pockets. The acoustic transducer comprising the diaphragm has a well-balanced frequency characteristic across a wide frequency range.

8 Claims, 4 Drawing Sheets

DIAPHRAGM FOR ACOUSTIC TRANSDUCER

CROSS-REFERENCE TO RELATED APPLICATIONS

Figure 1:
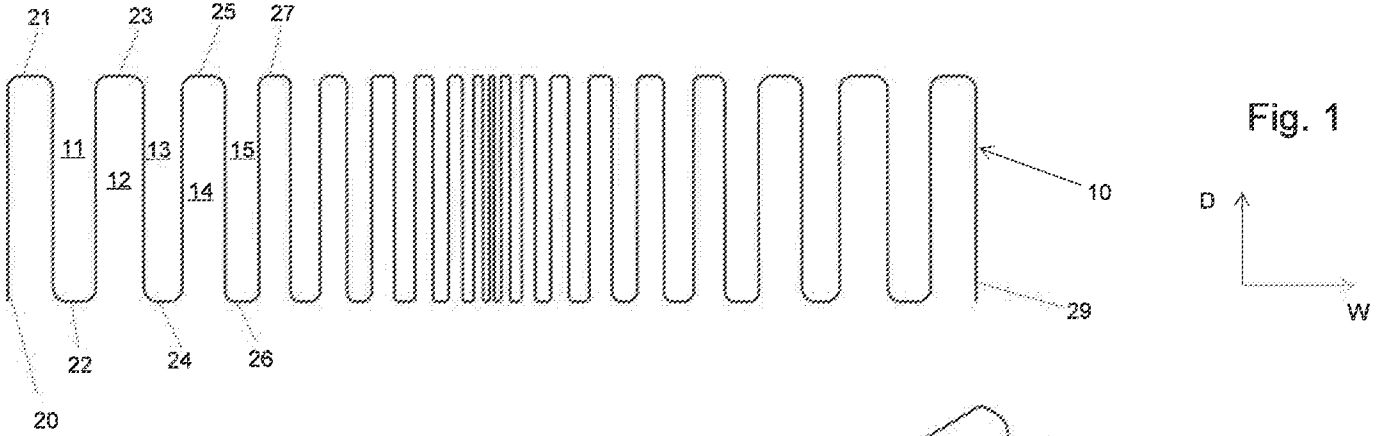

The present application claims priority to German Patent Application No. DE 10 2019 111 578.7, filed on May 3, 2019.

BACKGROUND OF THE INVENTION

1. Field of the Invention

The invention relates to a diaphragm or membrane for an acoustic transducer, specifically for an air motion transformer (AMT), and to such acoustic transducer.

2. Description of the Related Art

Acoustic transducers of the AMT type are known from U.S. Pat. No. 3,636,278 A. They comprise a diaphragm which is folded back and forth such that air filled pockets are formed within the folds. The diaphragm is disposed between pole plates within an air gap of a magnetic circuit. Electric conductors are arranged on the diaphragm. An electric current through the conductors within the magnetic field between the pole plates results in a deformation of the folds whereby the air filled pockets are narrowed or expanded and thereby eject or aspirate air. There is a certain transformation between the velocity of the diaphragm and the velocity of the air thus driven. With a narrow and deep pocket, for example, a slight narrowing by a relatively slow movement of the side walls of the pocket towards each other may lead to a relatively quick ejection of the air contained in the pocket. The name air motion transformer for this type of acoustic transducer reflects that transformation.

In a conventional transducer of the AMT type, all folds and the pockets formed by them have the same dimensions, i.e. the same depth, width and length. EP2158789 B1 discloses a diaphragm for an AMT transducer which is divided into different segments. The segments and their vibrations are isolated from each other in that the borders between them are fixed in space by rigid bars. A central segment contains a number of relatively small pockets of mutual identical dimensions. It operates as a tweeter in the treble range. Peripheral segments have larger pockets of mutually identical dimensions. Those segments operate as loudspeakers in the bass or mid-range.

Known acoustic transducers of the AMT type have the disadvantage that their electro-acoustic transmission characteristic has an undesirable frequency dependency. Also a diaphragm divided into segments in accordance with EP2158789 does not provide an equalized and well balanced frequency response. Many applications, however, require a broad band transducer which has a well balanced response over the entire range of the frequency spectrum that is perceivable by the human ear such as from about 20 Hz to about 20 kHz.

It is, therefore, an object of the invention to provide a diaphragm and an acoustic transducer having improved frequency characteristics.

BRIEF SUMMARY OF THE INVENTION

This object is solved by a diaphragm and an acoustic transducer as set forth in the appended claims.

The inventive diaphragm for an acoustic AMT transducer has folds which form mutually adjacent pockets which are alternatingly open on one and the other of the two opposing faces (sides) of the diaphragm. The inventive diaphragm differs from known diaphragms for AMT transducers in that the transformation ratio of the velocity of the diaphragm in relation to the velocity of the driven air varies steadily or continuously from one to the next fold, i.e. from one to the next pocket on the diaphragm. This makes it possible to obtain equalized and well-balanced response and transmission characteristics over a wide frequency range.

The dependent claims relate to preferred embodiments of the invention.

In some embodiments, the respective width, depth and/or length of each pocket increases continuously or steadily from one to the next pocket over a plurality of pockets, such as at least three or five pockets, preferably at least one fourth or half of the total number of pockets of the diaphragm. In the alternative, the pocket width, depth and/or length may steadily decrease. For example, the pocket width, depth or length can decrease steadily from one to the other (opposing) end of the diaphragm. But the pocket width, depth or length can also increase steadily from one to the other end of the diaphragm. Preferably, the pocket width, depth or length can decrease steadily from one end to the center of the diaphragm and then increase steadily further from the center to the opposite end of the diaphragm. Alternatively, it may increase from one end to the center of the diaphragm and then decrease again from the center to the opposite end. Due to the steady increase or decrease, a given pocket has two neighboring pockets, one on each side, from which it differs in width, depth and/or length. For example, the neighboring pocket on one side of a given pocket is wider, deeper or longer than the given pocket, and the neighboring pocket on the other side of the give pocket is narrower, shallower or shorter than the given pocket between its neighbors. In a preferred embodiment, this applies to any given pocket: no two mutually neighboring pockets are the same in width, depth and length. The aforesaid conditions for the width, depth and/or length apply at least to neighboring pockets which are open on one face of the diaphragm, but apply preferably to the multitude of all pockets open on either face of the diaphragm. The inventive configuration avoids pronounced resonances in the vibration characteristics of the diaphragm. The frequency response over the desired frequency range can be easily adjusted by selection of the smallest and largest pocket width, depth and/or length and the amount of variation in pocket width, depth and/or length from one to the next neighboring pocket.

In the acoustic transducer, the diaphragm is disposed within the airgap between pole plates of a magnetic circuit. Preferably, there is a distance between each pole plate and the folds of the diaphragm which is constant and remains the same for all folds. Thus, the smaller the depth of the pockets, the smaller is the distance between the opposing pole plates. This increases the magnetic flux density in relation to areas where the pole plates have larger distances from each other. The increased magnetic flux density can be used to adjust the frequency response, wherein the acoustic pressure of higher frequency sound as emitted from less deep pockets is increased.

The pole plates can be manufactures particularly easily if they have the same constant thickness everywhere. At places of reduced distance between the two pole plates, the pole plates are bent towards each other. That is, with a view from one pole plate, the other is convex, and when viewed from the outside, it is curved concave. For a further increase of the magnetic flux density at places of reduced distance between the two pole plates, the thickness of one or that of both pole plates at those places may also be reduced in comparison to other places. The invention is particularly suited for headphones because it can produce sufficient diaphragm swing for all frequencies of the acoustic spectrum that can be perceived by the human ear. In this regard, the invention dispenses with conventional wisdom that a wide frequency range spanning three decades from 20 Hz to 20 Hz, for example, requires several independent systems such as specific speakers for treble, bass and the mid-range. As a result, the invention provides an acoustic transducer which can fit into compact systems such as headphones.

BRIEF DESCRIPTION OF THE SEVERAL VIEWS OF THE DRAWING(S)

Figure 2:
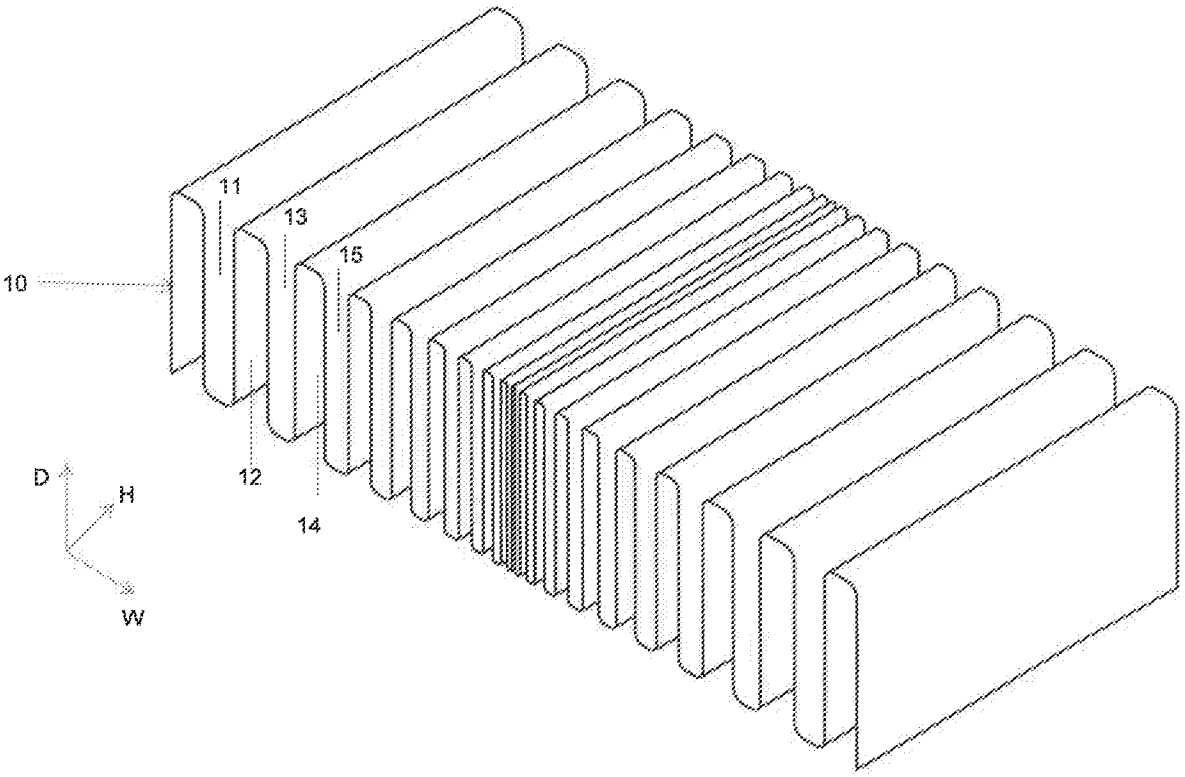
Figure 3:
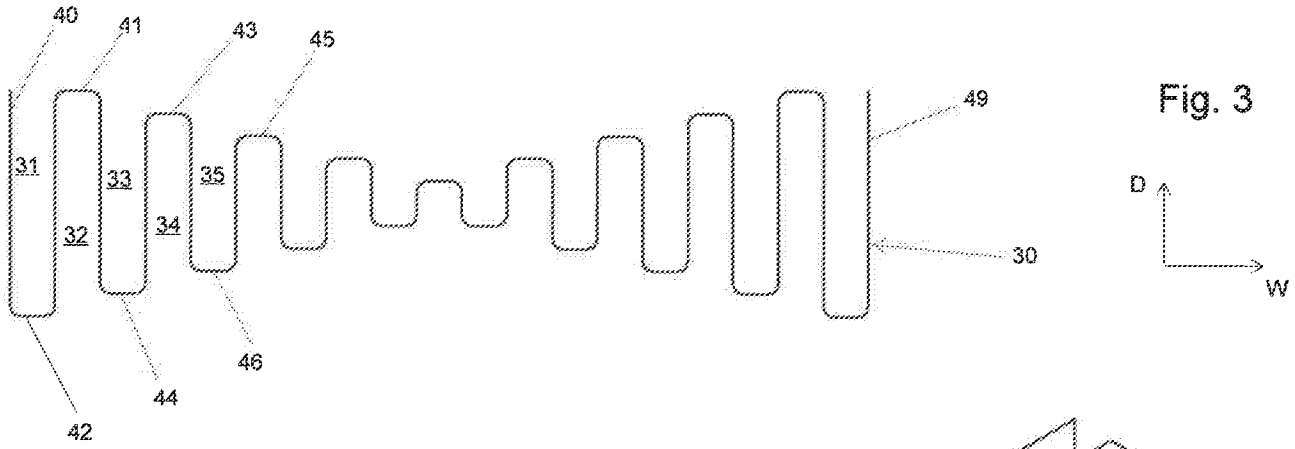
Figure 4:
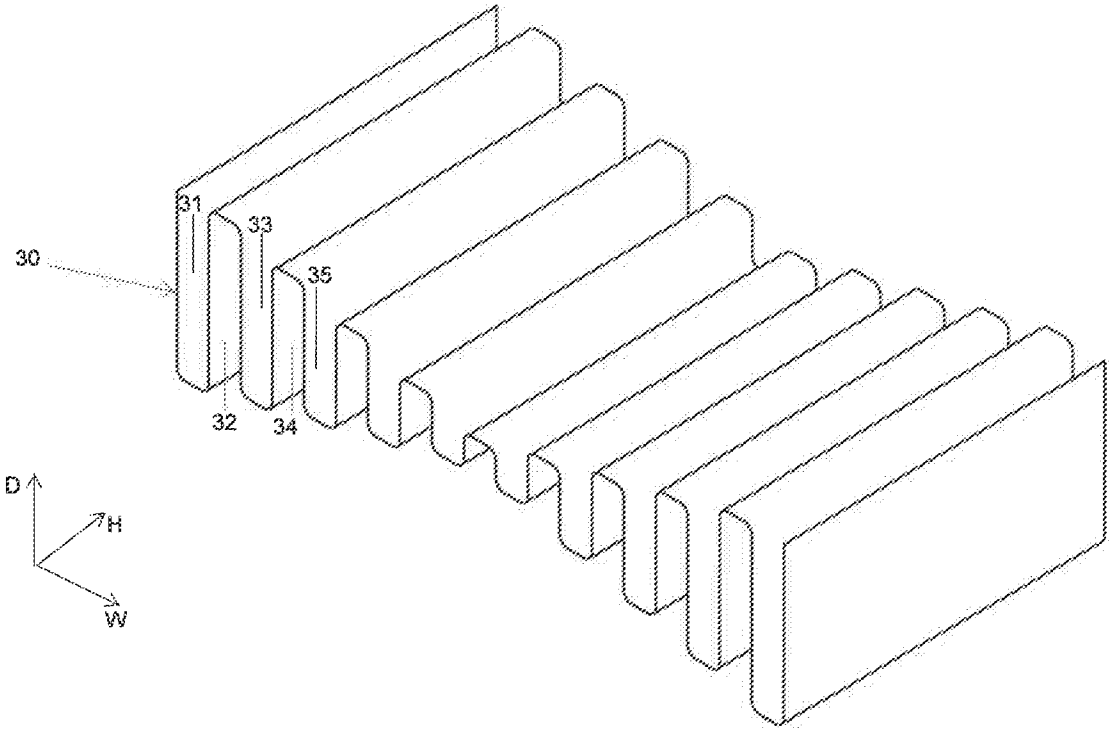
Figure 5:
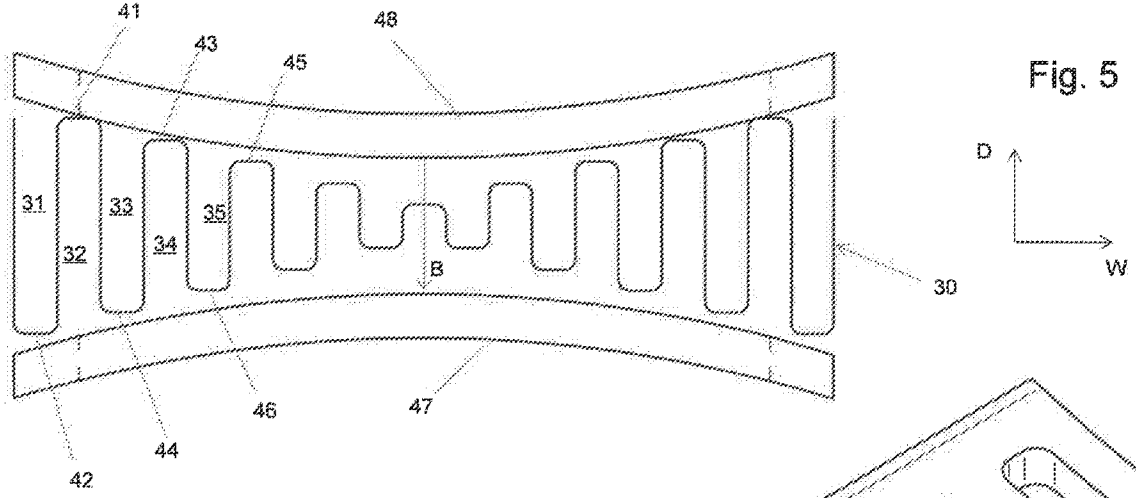
Figure 6:
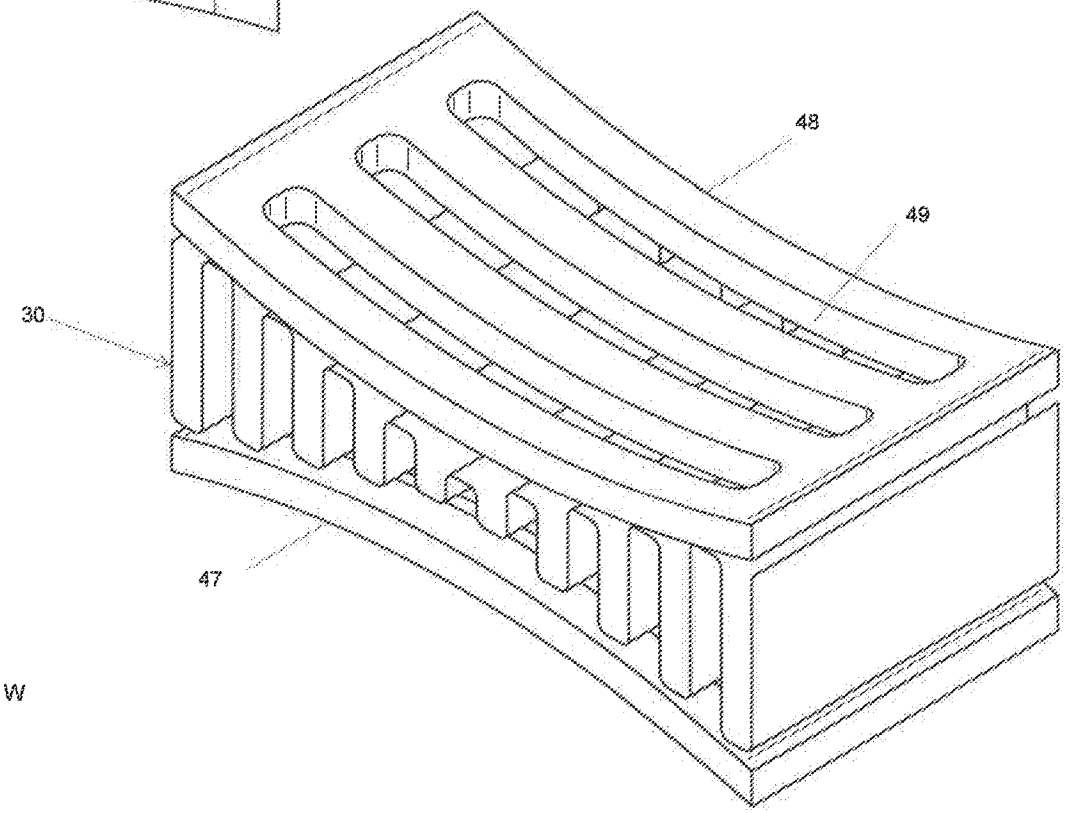
Figure 6:
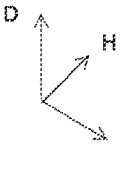
Figure 7:
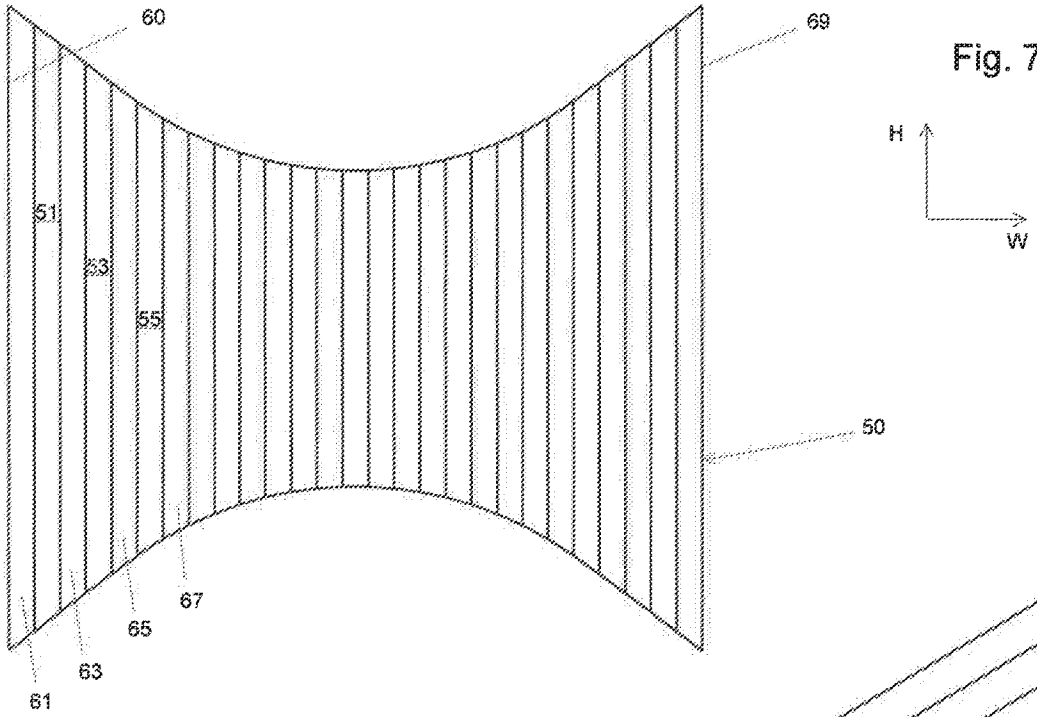
Figure 8:
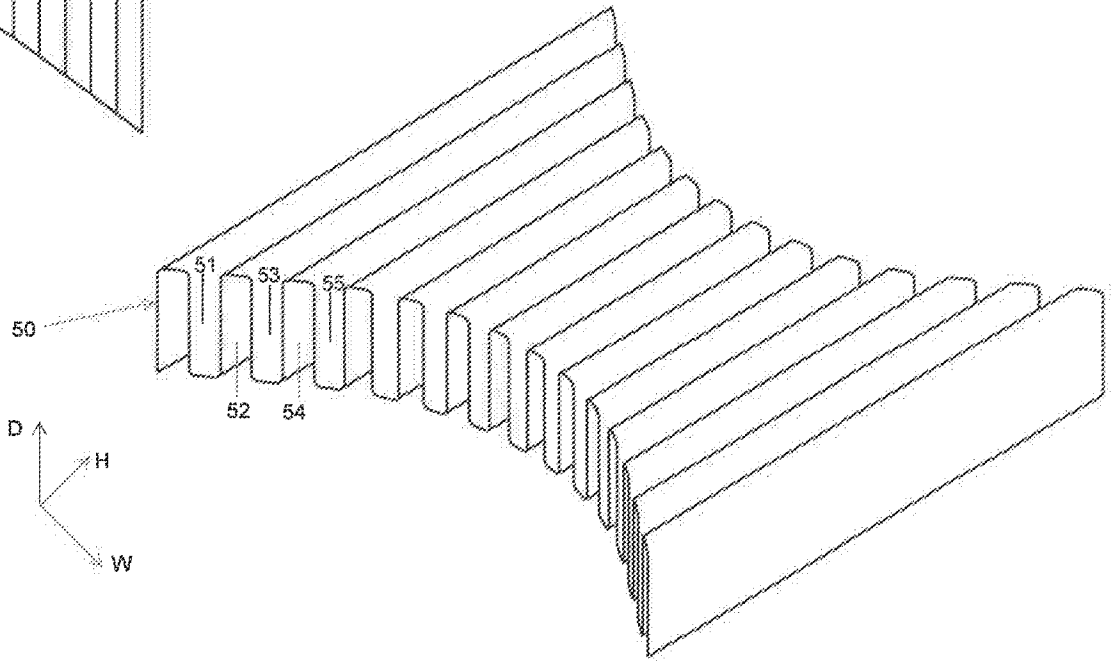

The present invention will be more fully understood and appreciated by reading the following Detailed Description in conjunction with the accompanying drawings, in which:

FIG. 1 shows a cross section of a diaphragm for an acoustic transducer in accordance with an embodiment, FIG. 2 is a perspective view of the diaphragm of FIG. 1, FIG. 3 shows a cross section of a diaphragm for an acoustic transducer in accordance with a further embodiment, FIG. 4 is a perspective view of the diaphragm of FIG. 3, FIG. 5 shows a cross section through an acoustic transducer including the diaphragm of FIG. 3, FIG. 6 is a perspective view of the acoustic transducer of FIG. 5, FIG. 7 is a plan view of a diaphragm for an acoustic transducer in accordance with a still further embodiment, and FIG. 8 is a perspective view of the diaphragm of FIG. 7.

DETAILED DESCRIPTION OF THE INVENTION

Same reference sings designate same elements throughout the Figures. For ease of referring to the directions in space, each figure shows the axes of a co-ordinate system where the direction of the width of the diaphragm is designated by W, the direction of the height of the diaphragm is designated by H and the direction of thickness or depth of the diaphragm is designated by D. References to width, height and depth relate to this coordinate system.

The diaphragm 10 shown in FIGS. 1 and 2 is suitable for use in an acoustic AMT transducer. The diaphragm is folded back and forth into depth direction D so that mountain folds 21, 23, 25, 27 and valley folds 22, 24, 26 alternate along the direction of the width W of the diaphragm. Thereby, pockets 11, 13, 15 are formed between mutually neighboring mountain folds, which pockets are open on one face of the diaphragm with respect to the depth direction (upwardly in the Figs.). Similarly, pockets 12, 14 are formed between mutually neighboring valley folds, the pockets being open on the other face of the diaphragm with respect to the depth direction (downwardly in the Figs.). The length of each of the folds or pockets extends in the direction of the height H of the diaphragm.

The diaphragm 10 is made from an electrical isolator but is provided with electrical conductors (not shown) extending in height direction H in the usual fashion. When used in an acoustic transducer, the diaphragm is exposed to a magnetic field whose lines of flux extend in depth direction D. An electric current in the conductors within the magnetic field generates forces which constrict (narrow) the upwardly open pockets 11, 13, 15 in width direction W and simultaneously expand (widen) the downwardly open pockets 12, 14, or vice versa depending on the direction of current flow. Thereby, air is driven out of the pockets on one face of the diaphragm 10 and is drawn into the pockets on the other face of the diaphragm 10.

It is a specific feature of the diaphragm 10 that the width of at least the pockets 11, 13, 15 which are open on one face of the diaphragm continuously increases or continuously decreases from pocket to pocket along the diaphragm. Likewise, the width of the pockets 12, 14 which are open on the other face of the diaphragm continuously increases or continuously decreases from pocket to pocket along the diaphragm. In the example shown in the Figs., the width of each pocket at the end 20 (left side in the Figs.) of the diaphragm 10 is large, continuously decreases towards the center of the diaphragm and then continuously increases again from the center towards the opposite end 29 (right side in the Figs.) of the diaphragm 10.

No two mutually neighboring pockets 11, 13 or 13, 15 which are open on the same face of the diaphragm have the same width. For example, the pocket 11 which is the left neighbor of pocket 13 has a larger width than the pocket 13, and the pocket 15 which is the right neighbor of pocket 13 has a smaller width than the pocket 13. Likewise, the pocket 12 has a larger width than the pocket 14. But two pockets which are directly next to each other and are open on different faces of the diaphragm may have the same width. For example, pockets 11 and 12 may have the same width which is relatively larger in relation to pockets 13 and 14 which also have the same width which, however, is relatively smaller. But the width of the pocket 12 may also be selected so as to be intermediate between that of pockets 11 and 13, and the width of pocket 14 may be selected to be intermediate between that of pockets 13 and 15.

The shape of the diaphragm 10 results in that, when the diaphragm 10 is used in an acoustic transducer, the ratio between the velocity of the diaphragm 10 to the velocity of the air driven by the pockets of the diaphragm, i.e. the transformation of the diaphragm velocity to the air velocity steadily changes from pock-et to pocket across the surface of the diaphragm. This results in a homogenous frequency response across a wide frequency range. The frequency response across the frequency range can be readily adjusted by selection of the largest and smallest pocket width and the amount of change of the pocket width from one to the next neighboring pocket.

The diaphragm 30 shown in FIGS. 3 and 4 is similar to the diaphragm 10 from FIGS. 1 and 2. Pockets 31, 33, 35 which are open on one face of the diaphragm (upwards in the Figs.) are formed between neighboring mountain folds 41, 43, 45. Pockets 32, 34 which are open on the other face of the diaphragm (downwards in the Figs.) are formed between neighboring valley folds 42, 44, 46. In the following, the differences from the diaphragm 10 will be described.

While all pockets 11 . . . 15 of the diaphragm 10 have the same depth, the depth of the pockets 31 . . . 35 of the diaphragm 30 increases or decreases continuously from pocket to pocket across the diaphragm. In the example shown, the depth of each pocket at the end 40 (left side in the Figs.) of the diaphragm 30 is large, the depth decreases continuously towards the center and then again increases continuously from the center to the opposite end 49 (right side in the Figs.) of the diaphragm 30. As can be seen from FIGS. 3 and 4, most pockets 31 . . . 35 have two side walls which do not have the same depth: for example, the side wall of pocket 32 on the side towards fold 42 is deeper than the side wall of pocket 32 on the side towards the fold 44. In the following, the depth of a pocket is meant to be the average dimension in depth direction of the pocket's two side walls.

No two pockets 31 . . . 35 next to each other have the same depth. For example, the pocket 31 on the left side of the pocket 32 has a larger depth than the pock-et 32, and the pocket 33 on the right side of the pocket 32 has a smaller depth than the pocket 32.

Otherwise, the diaphragm 30 resembles the diaphragm 10.

Also in the diaphragm 30, the transformation of the diaphragm velocity to the air velocity varies from pocket to pocket across the diaphragm. This results in an even and well-balanced frequency response across a wide frequency range. The frequency response across the frequency range can be easily adjusted by selection of the largest and the smallest pocket depth and the amount of change of the pocket depth from one to the next neighboring pocket.

FIGS. 5 and 6 show an acoustic transducer including the diaphragm 30. The diaphragm 30 is disposed within the air gap of a magnetic circuit between two pole plates 47, 48. In depth direction, the pole plate 47 is arranged below the diaphragm and the pole plate 48 is arranged above the diaphragm. The magnetic circuit is closed by a permanent magnet and a yoke (both not shown).

The magnetic field B extends approximately along the depth direction within the magnetic gap. The pole plate 48 has slit-shaped openings 49 through which the sound generated by the acoustic transducer is radiated to the outside.

At least one of the pole plates but preferably both pole plates 47, 48 follow the profile of the pockets 31 . . . 35 of varied depth, as shown in the Figs.: the pole plate 47 has approximately the same distance from each of the mountain folds 41, 43, 45. The pole plate 48 has approximately the same distance from each of the valley folds 42, 44, 46. Therefore, the magnetic gap between the pole plates is narrower and the magnetic flux larger in the area of smaller pocket depth than in the area of larger pocket depth. The stronger magnetic flux increases the efficiency of the pockets of smaller depth and thereby enhances the emission of high frequency sound by them. Although, the pole plates 47, 48 have a substantially constant thickness as measured in depth direction D, the thickness may also be reduced in the area of smaller pocket depth so that the magnetic flux will be further increased there.

The diaphragm 50 shown in FIGS. 7 and 8 resembles the diaphragms 10 and 30 of FIGS. 1 to 6. Pockets 51, 53, 55, which are open on one face of the diaphragm (above the drawing plane in FIG. 7 upwards in FIG. 8) are formed between neighboring mountain folds 61, 63, 65. Pockets 52, 54 which are open on the other face of the diaphragm (below the drawing plane in FIG. 7 and downwards in FIG. 8) are formed between neighboring valley folds. The differences from the diaphragms 10 and 30 will be described in the following.

While all folds or pockets of the diaphragms 10 and 30 have the same length along the direction of height H of the diaphragms 10, 30, the length of the pockets 51 . . . 55 of the diaphragm 50 increases or decreases continuously from pocket to pocket across the diaphragm. In the example shown, the length of each pocket is large at the end 60 (left side in the Figs.) of the diaphragm 50, decreases continuously towards the center of the diaphragm and then increases continuously again from the center towards the opposite end 69 (right side in the Figs.) of the diaphragm 50. As can be seen from FIGS. 7 and 8, most pockets 51 . . . 55 have two side walls which have not the same length: for example, the side wall of the pocket 51 on the side towards the fold 61 is longer than the side wall on the side towards the fold 63. The length of a pocket is meant to be the average dimension of the pocket's two side walls as measured in the direction of the height H of the diaphragm 50.

No two pockets 51 . . . 55 next to each other have the same length. For example, the pocket 51 on the left side of pocket 52 has a larger length than the pocket 52. The pocket 53 on the right side of the pocket 52 has a smaller length than the pocket 52.

Otherwise the diaphragm 50 is similar to the diaphragms 10 and 30.

Also in the diaphragm 50, the transformation of the diaphragm velocity to the air velocity varies steadily from pocket to pocket across the surface of the diaphragm. This results in a well-balanced frequency response across a wide frequency range. The frequency response across the frequency range can be easily adjusted by selection of the largest and the smallest pocket length and the amount of change of the pocket length from one to the next neighboring pocket.

In each of the embodiments described above, it is either the width, the depth or the length of the pockets which varies from pocket to pocket. But variations of the width, depth, and/or length can also be combined with each other for enhancing the effect of the invention. Such combinations again avoid undesirable resonances in the frequency characteristics of the diaphragm. For example, the embodiment of FIGS. 3 and 4 can be modified in that its variation in pocket depth is combined with a variation of pocket width as in FIGS. 1 and 2. The central pockets of smaller depth then also have smaller width than the peripheral pockets. In this modification of the FIGS. 3, 4 embodiment, it is particularly preferred that the ratio of pocket depth to pocket width remains larger for the peripheral pockets than for the central pockets; then, the transformation ratio of the velocity of the diaphragm in relation to the velocity of the driven air provides improved sound emission in the bass range by the peripheral pockets.

What is claimed is:

1. A headphone, comprising:

an acoustic transducer formed by an air motion transformer having a diaphragm positioned between a pair of pole plates of a magnetic circuit, wherein the diaphragm is folded such that the folds form pockets, wherein pockets next to each other are alternatingly open on one face and the other face of the diaphragm, characterized in that the pockets are dimensioned such that the transformation ratio from the diaphragm velocity to the velocity of the air driven by the pockets of the diaphragm in use varies steadily from pocket to pocket across the diaphragm.

2. A headphone in accordance with claim 1, wherein the widths of at least those of the pockets which are open on one face of the diaphragm increase or decrease steadily from pocket to pocket, so that at least one of those pockets has a width which differs from that of any of its two neighboring pockets.

3. A headphone in accordance with claim 1, wherein the depths of at least those of the pockets which are open on one face of the diaphragm in-crease or decrease steadily from pocket to pocket, so that at least one of those pockets has a depth which is different from that of any of its two neighboring pockets.

4. A headphone in accordance with claim 1, wherein the lengths of at least those of the pockets which are open on one face of the diaphragm increase or decrease steadily from pocket to pocket so that at least one of those pockets has a length which is different from that of any of its two neighboring pockets.

5. A headphone in accordance with claim 1, wherein the widths, depths or lengths of also those pockets which are open on the other face of the diaphragm increase or decrease steadily from pocket to pocket so that at least one of those pockets has a width, depth or length which differs from that of any of its two neighboring pockets.

6. A headphone in accordance with claim 1, wherein said widths, depths or lengths decrease steadily from one end of the diaphragm towards the center of the diaphragm and then increase steadily from the center of the diaphragm towards the opposite end of the diaphragm.

7. A headphone in accordance with claim 1, wherein the pole plates maintain a constant distance to each of the folds of the diaphragm.

8. A headphone in accordance with claim 7, wherein the pole plates are curved in a concave curvature when viewed from the outside of the transducer.

* * * * *